United States Patent [19]

Schiele et al.

[11] Patent Number: 4,823,675

[45] Date of Patent: Apr. 25, 1989

[54] APPARATUS FOR LOADING GUNS, PARTICULARLY TANK HOWITZERS

[75] Inventors: August Schiele; Gert Kausträter, both of Augsburg, Fed. Rep. of Germany

[73] Assignee: Kuka Wehrtechnik GmbH, Augsburg, Fed. Rep. of Germany

[21] Appl. No.: 83,289

[22] Filed: Aug. 10, 1987

[30] Foreign Application Priority Data

Aug. 9, 1986 [DE] Fed. Rep. of Germany ..... 3627042

[51] Int. Cl.[4] ..... F41F 9/04; F41F 9/10

[52] U.S. Cl. ..... 89/46; 89/45; 89/33.05

[58] Field of Search ..... 89/45, 46, 47, 36.08, 89/33.05

[56] References Cited

U.S. PATENT DOCUMENTS

| | | |
|---|---|---|
| 1,304,583 | 5/1919 | McClain . |
| 2,499,271 | 2/1950 | Harvey et al. . |
| 3,501,996 | 3/1970 | Lipp et al. . |
| 3,884,119 | 5/1975 | Zouck . |
| 4,038,906 | 8/1977 | Tidstrom . |
| 4,313,363 | 2/1982 | Schreckenberg . |
| 4,384,509 | 5/1983 | Hallqvist . |
| 4,388,854 | 6/1983 | Dabrowski et al. . |
| 4,481,862 | 11/1984 | Wiethoff et al. . |
| 4,690,031 | 9/1987 | Metz et al. . |

FOREIGN PATENT DOCUMENTS

| | | | |
|---|---|---|---|
| 51119 | 5/1982 | European Pat. Off. | 89/47 |
| 53-33000 | 3/1978 | Japan | 89/46 |
| 9861 | of 1909 | United Kingdom | 89/46 |
| 2153496 | 8/1985 | United Kingdom | 89/46 |

*Primary Examiner*—Deborah L. Kyle
*Assistant Examiner*—Stephen Johnson
*Attorney, Agent, or Firm*—Antonelli, Terry & Wands

[57] ABSTRACT

In an apparatus for loading guns, particularly tank howitzers, from a rotary magazine containing the shells and positioned below and alongside the gun barrel, for simplifying construction and movement sequences a substantially vertical loading arm pivotable about a vertical axis between a reception position in the vicinity of the rotary magazine and a position below and upstream of the gun barrel is provided, the loading arm having at least one gripper for a shell and in the last-mentioned position is pivotable about an approximately horizontal axis at right angles to the core axis of the gun barrel into a loading position from which the shell aligned with the core axis can be transported by a rammer into the gun chamber.

9 Claims, 6 Drawing Sheets

APPARATUS FOR LOADING GUNS, PARTICULARLY TANK HOWITZERS

BACKGROUND OF THE INVENTION

The present invention relates to an apparatus for loading guns, particularly tank howitzers, from a rotary magazine containing the bullets of shells located alongside and below the gun barrel.

Automatic loaders are known for howitzers and guns which permit an automatic insertion of the bullets in the chamber of the gun. In an improved construction, these loaders also permit the automatic selection of different bullets, which are generally called from a remote magazine and are supplied over long distances to the actual loader. In all automatic loaders, it is a question of very reliably and non-manually permitting a rapid loading process. The known loaders have a very complicated construction and are therefore expensive. In general, they also have a large space requirement, so that difficulties are encountered in housing the same, particularly in tanks. Due to the degree of automation thereof, they are also fault-prone both from the technological and operational standpoints.

SUMMARY OF THE INVENTION

The aim underlying the present invention is to use simple constructional means and easily monitored movement sequences to ensure a non-manual loading process, while thereby providing an inexpensive, space-saving apparatus.

On the basis of the aforementioned apparatus with a rotary magazine for the bullets or shells, the aforementioned aim is obtained by a substantially vertically positioned loading arm pivotable about a vertical axis between a reception position in the vicinity of the rotary magazine and a position below and upstream of the gun barrel, with the loading arm having at least one gripper for a bullet or shell and in the last-mentioned position is pivotable about an approximately horizontal axis, at the right angles to the bore axis of the gun barrel into a loading position from which the bullet or shell aligned with the bore axis can be transported by a rammer into the chamber of the gun.

The rotary magazine, which contains a given number of bullets or shells, is driven in timed manner and moves one shell after the other into the reception position, where it is grasped by the substantially vertical loading arm pivoted about the vertical axis into the reception position by the gripper fitted thereto and is fixed by clamping the gripper to the loading arm. The loading arm is then pivoted about the vertical axis into the position below and upstream of the gun barrel and is then pivoted about the horizontal axis in the upwards direction until the shell is aligned with the core axis of the gun barrel. The shell is then transported from this position into the gun barrel chamber by a rammer. After introducing a propellant charge behind the shell base and the closing of the breech block the weapon can be fired.

The inventive apparatus is constructed from simple components (rotary magazine and loading arm). The complete loading process includes simple movement sequences, namely, the gripping movement on grasping the shell in the reception position and two successively performed pivoting movements of the loading arm. The simple movement sequences permits a rapid loading process of roughly 6–7 seconds, so that high speed operation is possible. As a result of the simple construction, it is also possible to operate the apparatus manually, so as to be able to load e.g. in the case of a fault (power failure) or when the magazine has run empty. Through the positioning of the loading arm upstream of and below the gun barrel, even in manual operation there is no need to raise the shells over any significant height. Finally, the simple construction of the apparatus also permits an inexpensive re-equipping of existing guns.

According to a preferred embodiment of the invention, the rammer is fitted to the loading arm and not, as is otherwise conventional, to the gun. Thus, it also performs all the movements of the loading arm, which ensures that it is always correctly positioned. This also avoids an overlapping function of the gun and the loader.

According to another feature of the invention the horizontal pivot pin of the loading arm is connected to the gun and preferably intersects the core axis of the gun barrel.

As a result of this construction, the entire loading apparatus is coupled to the gun barrel, the axis configuration leading to the further advantage that the loading apparatus follows the elevation, so that it is not necessary to bring the gun into an indexed loading position before each loading process.

According to another embodiment of the invention, the loading arm has a conveyor revolving parallel thereto with a driver engaging below the shell base in the reception position and by which the shell in the loading position can be transported sufficiently far into the chamber for it to be engaged by the rammer.

The conveyor can in the simplest case be a revolving chain, which is fitted within the loading arm and projects with its driver over the bearing surface of the shell on the loading arm, so as to engage below the base of the shell. The conveyor is controlled in such a way that the driver is in its lower position when the loading arm passes into the reception position and the gripper grips the shell located in the rotary magazine, so that during this movement the driver also passes beneath the shell base. After pivoting back the loading arm about the vertical axis and swinging up about the horizontal axis the bullet or shell is moved in the direction of the chamber by the conveyor or the driver engaging on the shell base, until a position is reached in which the rammer can engage on the shell, so that in the final part of the loading path it introduces same into the gun barrel.

Appropriately the rammer can be pivoted about an axis parallel to the loading arm from a position alongside the latter into a rammer position engaging on the shell. In this position, the rammer is only pivoted when the shell located on the loading arm has been advanced to such an extent by the driver that the rammer can engage on the shell.

According to another embodiment of the invention, a control system is provided linking together the indexing of the rotary magazine, the pivoting movements of the loading arm and the movements of the gripper and rammer, with the control means being coupled with the movement of the breech block on the gun, so that an automatic movement sequence is possible. Due to a manual drive for the loading arm, its gripper and the rammer provided for emergency operation, a manual loading process made easier for the gunner is also possible in an emergency or if the magazine has run empty.

BRIEF DESCRIPTION OF THE DRAWINGS

The invention is described in greater detail hereinafter relative to non-limitative embodiments and the attached drawings.

DETAILED DESCRIPTION OF THE PREFERRED EMBODIMENTS

Figure 3:
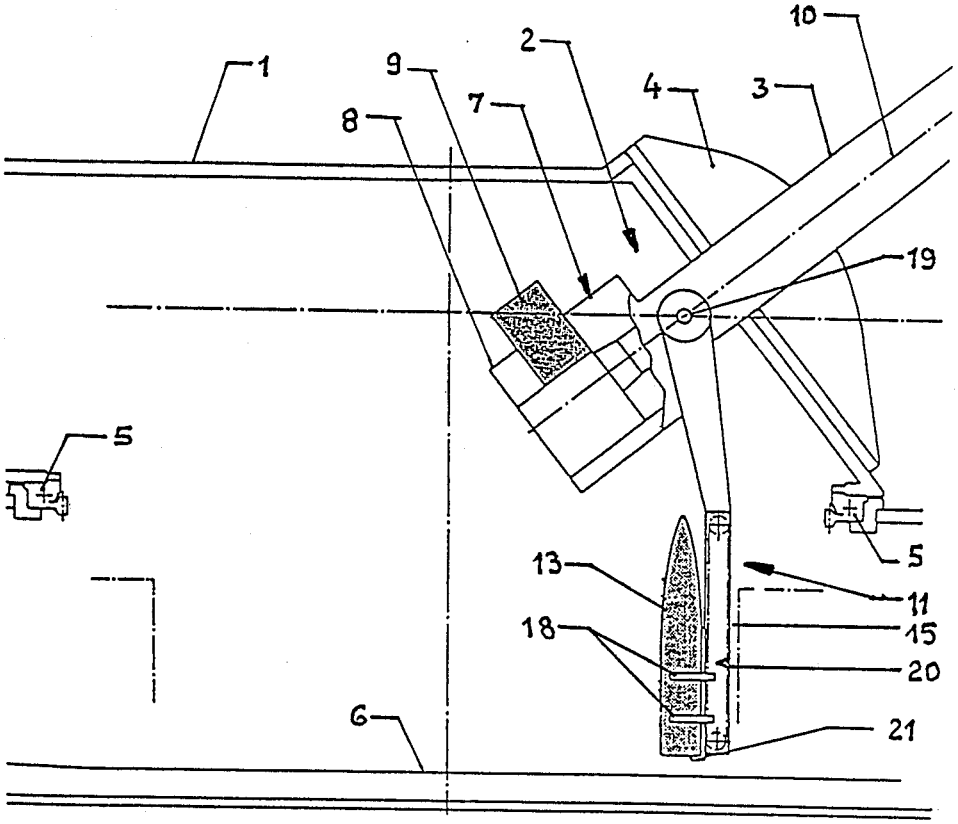
FIG. 3 a diagrammatic side view relative to the representation of FIGS. 1 and 2 in an intermediate position during the loading process.

The apparatus is shown in exemplified manner in the drawings when used on a tank howitzer. Reference is firstly made to FIG. 3, which shows the gun turret 1 and a gun 2, together with a gun barrel 3 and a shield 4. By a pivot bearing 5, the gun turret 1 is located on the tank and it is also possible to see the ground 6. At its end located in the gun turret 1, the gun 2 has chamber 7 with base portion 8. It is also possible to see the sliding wedge-type breech block 9, while the gun core axis is designated 10.

The loading apparatus 11 is associated with a gun 2. A revolving magazine 12 (FIGS. 1 and 2) stands on the ground 6 alongside and below the gun 2 and receives several bullets or shells 13 and transports the same in an endless loop on two substantially pitch circular movement paths. The movement direction of the revolving or rotary magazine 12 is indicated by directional arrow 14.

Figure 1:
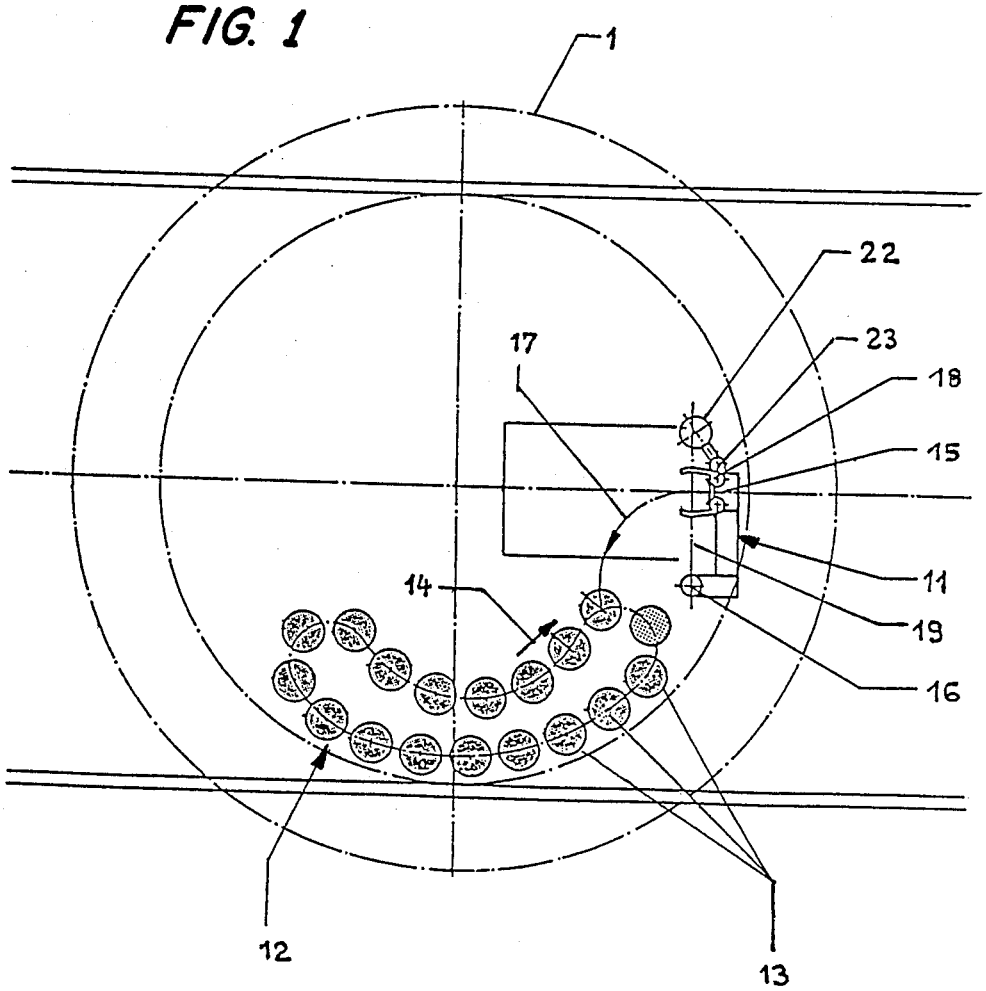
FIG. 1 a diagrammatic plan view of the embodiment when used in the turret of a tank before the start of a loading process.
Figure 2:
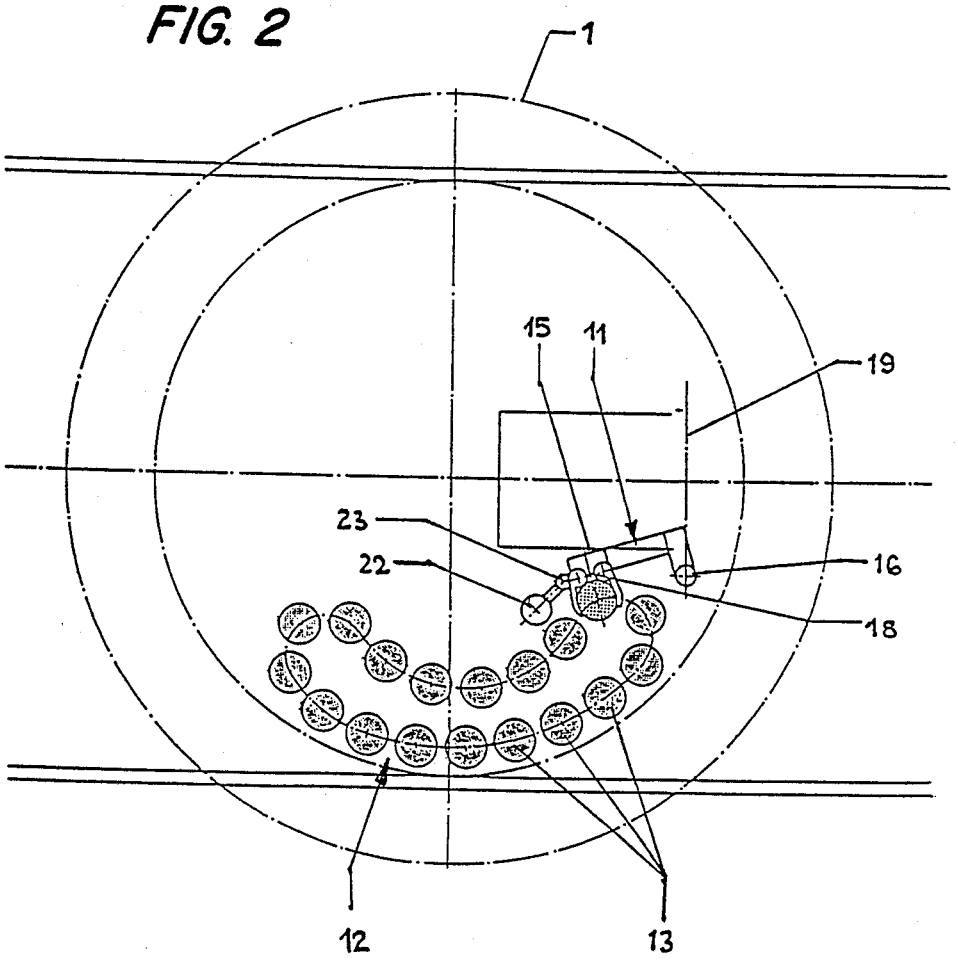
FIG. 2 a representation corresponding to FIG. 1 during the loading process.

Loading apparatus 11 has a loading arm 15, which is pivotable about a vertical axis 16 in the direction of arrow 17 (FIG. 1). At the end of the pivoting path the loading arm reachs a reception position on the rotary magazine 12 (FIG. 2).

In the illustrated embodiment, loading arm 2 has in each case two clamp-like grippers 18, which, in the reception position (FIG. 2), can grip and fix a shell in the rotary magazine 12. The loading arm 2 is also pivotable about a horizontal axis 19 which, as shown in FIG. 3, vertically intersects the core axis 10 of the gun barrel 3 or the axis of shield 4.

A rammer 2 also has a conveyor 20, e.g. a chain running parallel thereto and which is provided with a nose-like driver 21. In the reception position (FIG. 2), the driver engages below the base of the shell 13 to be received. The rammer 22 is fitted to loading arm 15 and can be pivoted about an axis 23 parallel to said loading arm (FIGS. 1 and 2). It is located in the swung out position alongside the loading arm, performs the movement sequences therewith and is only pivoted below its base for ramming the shell.

Figure 4:
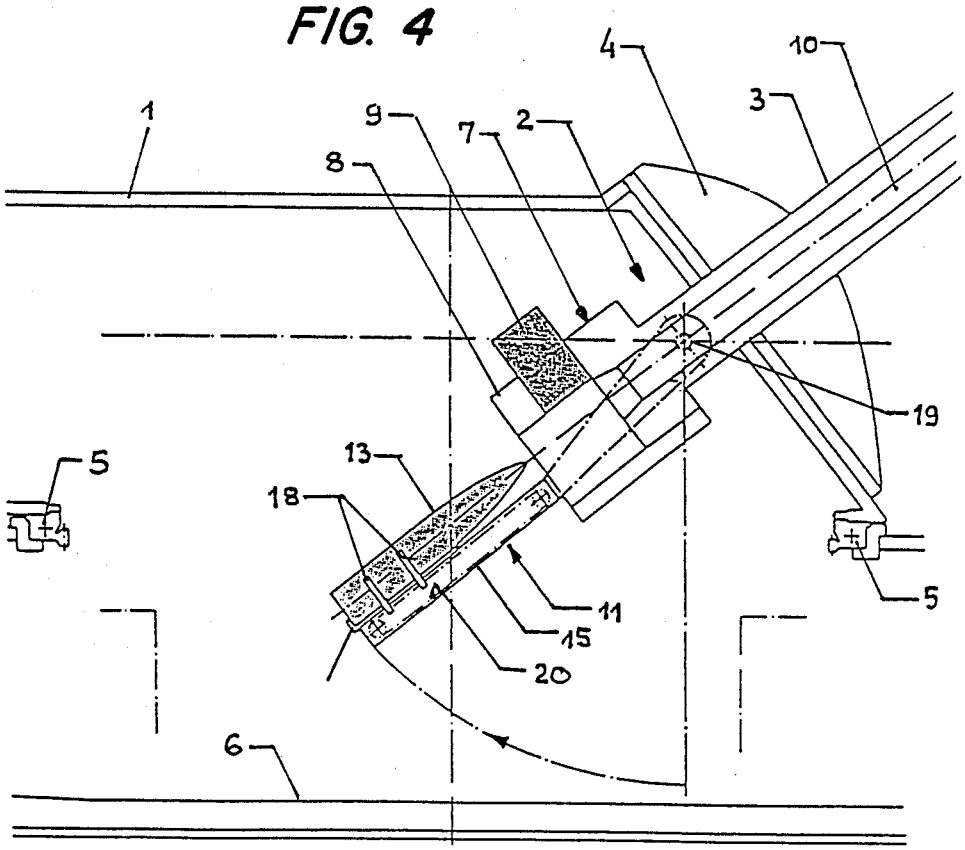
FIG. 4 a view corresponding to FIG. 3 with the apparatus in the loading position.
Figure 5:
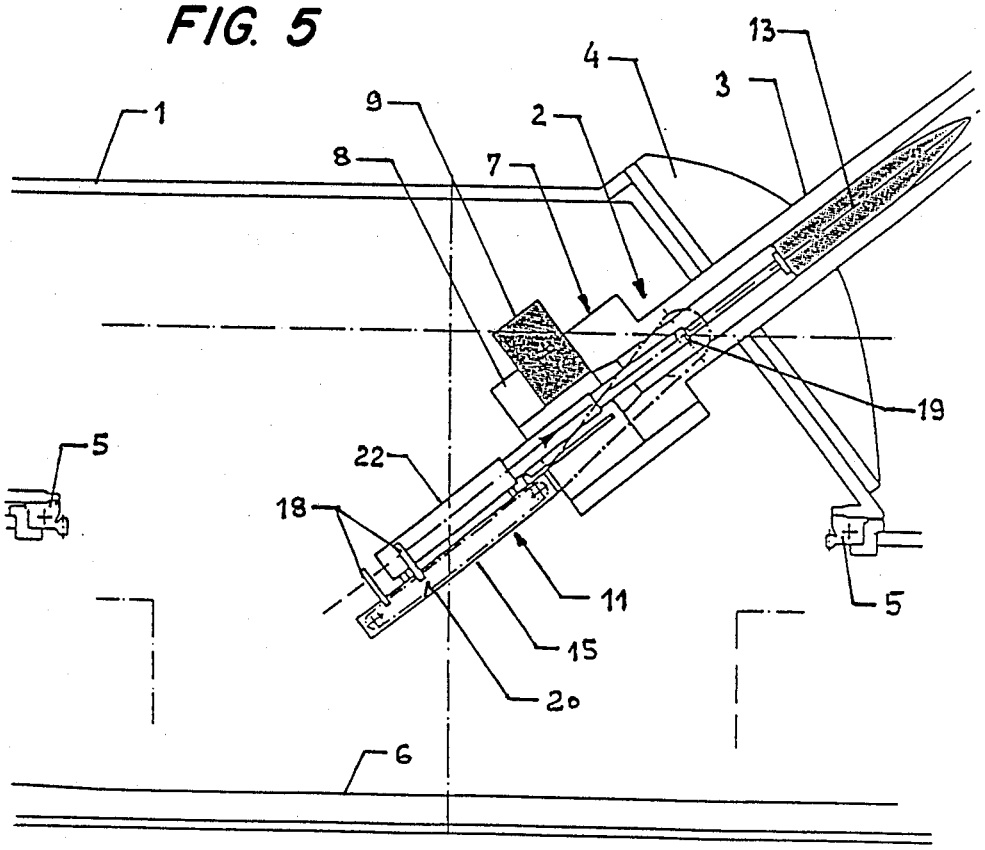
FIG. 5 a view corresponding to FIGS. 2 and 3 towards the end of the loading process.
Figure 6:
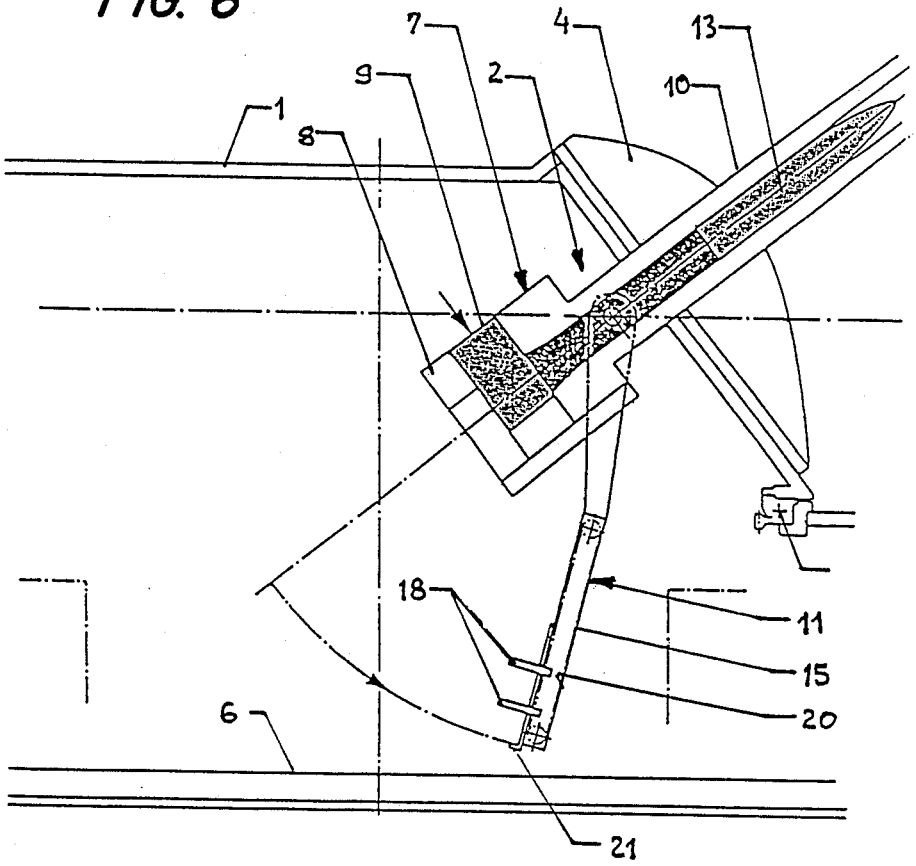
FIG. 6 a corresponding view after the loading process.

The apparatus operates in the following way. From the position according to FIG. 1, loading arm 15 is moved about vertical axis 16 in the direction of arrow 17 into the reception position (FIGS. 1 and 2). In this position grippers 18 are clamped so that they engage round the shell case. The driver 21 is simultaneously moved under the base of shell 13. The loading arm 15 is then pivoted back into the position according to FIGS. 1 and 3, in which the shell 13 is located below chamber 7 of gun 2 (FIG. 3). From this position loading arm 15 is pivoted about horizontal axis 19 into the loading position according to FIG. 4. As soon as the shell axis is aligned with the core axis 10 of gun barrel 3, the grippers 18 are released and the shell 13 is transported by the conveyor 20 and driver 21 into the chamber until the shell base terminates roughly with the rear edge of the base portion 8. Rammer 22 is then pivoted in about axis 23 on loading arm 15 and transports shell 13 into the gun barrel 3 (FIG. 5). In the illustrated embodiment, it is a hydraulic telescopic rammer 22. When the shell 13 has reached the position according to FIG. 5, then the telescope is retracted, the propellant charge is introduced into the chamber and the sliding wedge-type breech block 9 is closed. Immediately following the retraction of the telescope of the hydraulic telescopic rammer 22, the empty loading arm 15 can be moved back into the position according to FIG. 3 and a new loading process can begin.

What is claimed is:

1. An apparatus for loading howitzers having a gun barrel, the apparatus comprising a rotary magazine containing a plurality of shells and positioned below and alongside the gun barrel which comprises a gun chamber receiving one of said plurality of shells, wherein a substantially vertically positioned loading arm having a gripper for one of such plurality of shells is supported at a vertical axis and is pivotable about said vertical axis between a reception position at the rotary magazine for receiving one of said plurality of shells and a position below and in front of the chamber of the gun, said loading arm is pivotable about an approximately horizontal axis along a pivot-pin at right angles to a core axis of the gun barrel and is pivotable from said position below and in front of the chamber of the gun into a loading position in which the shell in the gripper is aligned with the core axis of the gun barrel, and wherein a rammer is fitted to the loading arm for transporting the shell from the loading position into the chamber of the gun.

2. An apparatus according to claim 1, wherein the horizontal pivot pin of the loading arm intersects the core axis of the gun barrel.

3. An apparatus according to one of the claims 1 or 2, wherein the loading arm includes a conveyor revolving parallel thereto with a driver engaging below the shell base in the reception position and by which the shell in the loading position can be transported into the chamber of the gun until engaged by the rammer.

4. An apparatus according to claim 3, wherein the rammer is pivotable about an axis parallel to the loading arm from a position alongside said loading arm into a rammer position engaging on the shell.

5. An apparatus according to claim 4, wherein control means are provided for interconnecting the indexing of the rotary magazine, the pivoting movements of the loading arm and the movements of the gripper and rammer and is coupled with the movement of the base portion on the gun.

6. An apparatus according to claim 5, wherein a manual drive for the loading arm, gripper and the rammer is provided for emergency operation.

7. An apparatus according to claim 1, wherein the rammer is pivotable about an axis parallel to the loading arm from a position alongside said load arm into a rammer position engaging on the shell.

8. An apparatus according to claim 1, wherein control means are provided for interconnecting the indexing of the rotary magazine, the pivoting movements of the loading arm and the movements of the gripper and rammer and is coupled with the movement of a base portion of the gun.

9. An apparatus according to claim 1, wherein a manual drive for the loading arm, gripper and the rammer is provided for emergency operation.

* * * * *